US010736369B2

(12) United States Patent
Shaw

(10) Patent No.: US 10,736,369 B2
(45) Date of Patent: Aug. 11, 2020

(54) CONVERTIBLE HEADGEAR

(71) Applicant: Faceball Cap, Inc., Houston, TX (US)

(72) Inventor: Paul Yan Shaw, Houston, TX (US)

(73) Assignee: Faceball Cap, Inc., Houston, TX (US)

( * ) Notice: Subject to any disclaimer, the term of this patent is extended or adjusted under 35 U.S.C. 154(b) by 0 days.

(21) Appl. No.: 16/612,706

(22) PCT Filed: Feb. 7, 2018

(86) PCT No.: PCT/US2018/017198

§ 371 (c)(1),
(2) Date: Nov. 11, 2019

(87) PCT Pub. No.: WO2019/156660

PCT Pub. Date: Aug. 15, 2019

(65) Prior Publication Data

US 2020/0205508 A1 Jul. 2, 2020

(51) Int. Cl.
*A42B 1/20* (2006.01)
*A42B 1/00* (2006.01)

(52) U.S. Cl.
CPC ..... *A42B 1/206* (2013.01); *A42B 1/004* (2013.01); *A42B 1/006* (2013.01)

(58) Field of Classification Search
CPC ..... A42B 1/206; A42B 1/004; A42B 1/006; A42B 1/008; A42B 1/045; A42B 1/22; A42B 1/225
USPC ..... 2/424, 173, 206, 209.12
See application file for complete search history.

(56) References Cited

U.S. PATENT DOCUMENTS 2,686,317 A 12/1951 Michaelis
2,586,064 A * 2/1952 Landry ..... A42B 1/045 2/173
4,062,067 A * 12/1977 Franzen ..... A42B 1/22 2/410
4,201,009 A * 5/1980 Burridge, Jr. ..... A42B 1/006 2/175.1
4,272,853 A 6/1981 Schuessler
4,593,417 A 6/1986 Brown et al.
4,628,543 A * 12/1986 Hunt ..... A63B 71/143 2/161.1
4,741,053 A * 5/1988 Okamura, Sr. ..... A42B 1/22 2/12
5,038,047 A * 8/1991 Still ..... A61B 6/107 128/857

(Continued)

FOREIGN PATENT DOCUMENTS

WO 2005092133 A2 10/2005
WO 2014047441 3/2014

OTHER PUBLICATIONS

Paloalto, Parasomnia, Jan. 13, 2017, https://web.archive.org/web/20170113201052/https://www.paloalto.va.gov/services/pulmonary/parasomnia.asp, accessed Apr. 24, 2020 (Year: 2017).*

(Continued)

*Primary Examiner* — Heather Mangine
(74) *Attorney, Agent, or Firm* — Crain, Caton and James

(57) ABSTRACT

A convertible headgear that includes an adjustable strap stored behind a sweatband that may be used to secure the headgear as a cap or mask, and modified rear crown panels that form a ventilation opening to facilitate a clear nasal passage airway when the headgear is worn as a mask.

10 Claims, 3 Drawing Sheets

(56) References Cited

U.S. PATENT DOCUMENTS 5,203,694 A * 4/1993 Klein ..... A42B 1/006 2/171.2
5,551,087 A * 9/1996 Blutstein ..... A42B 1/046 2/173
5,724,676 A * 3/1998 Amendolia ..... A42B 1/22 2/183
5,729,833 A * 3/1998 Judge ..... A42B 1/004 2/195.1
5,799,334 A * 9/1998 Griffith ..... A42B 1/225 2/171
5,815,849 A * 10/1998 Maletich ..... A42B 1/046 2/427
5,887,276 A * 3/1999 Lee ..... A42C 5/04 2/195.1
5,907,871 A * 6/1999 Austin ..... A42B 1/006 2/181
5,956,760 A 9/1999 Wine et al.
5,983,398 A * 11/1999 Kronenberger ..... A42B 1/06 2/181
6,067,658 A * 5/2000 Cho ..... A42B 1/22 2/181
6,094,749 A * 8/2000 Proctor ..... A42B 1/004 2/171.1
6,240,566 B1 * 6/2001 Scantlin ..... A42B 1/225 2/171
6,363,537 B1 * 4/2002 Park ..... A42B 1/22 2/181
6,442,762 B1 * 9/2002 Neumann ..... A42B 7/00 132/58
6,446,266 B1 * 9/2002 Park ..... A42B 1/22 2/175.1
6,604,975 B1 * 8/2003 Yeh ..... A41G 7/02 2/206
D482,849 S * 12/2003 Mansell ..... D2/871
6,810,533 B1 11/2004 Nahabedian et al.
6,920,644 B1 * 7/2005 Higgs ..... A42B 1/06 2/195.3
6,941,581 B1 * 9/2005 England ..... A42B 1/22 2/195.2
9,161,584 B1 * 10/2015 Garrett, Jr. ..... A42B 1/004
10,426,211 B1 * 10/2019 Rastinehad ..... A42B 1/24
2002/0095715 A1 * 7/2002 Hong ..... A42B 1/206 2/209.11
2004/0237172 A1 * 12/2004 Quinn ..... A41G 7/00 2/209.13
2005/0066402 A1 * 3/2005 Reitz ..... A42B 1/24 2/9
2005/0223475 A1 * 10/2005 Turner ..... A42B 1/062 2/209.4
2006/0143799 A1 * 7/2006 Young ..... A42B 1/22 2/209.13
2006/0174398 A1 * 8/2006 Proctor ..... A42B 1/067 2/209.13
2007/0061944 A1 * 3/2007 Briskie ..... A42B 1/225 2/209.3
2008/0092272 A1 * 4/2008 Vainio ..... A42B 1/225 2/209.7
2011/0023214 A1 * 2/2011 Hubbard ..... A42B 1/004 2/173
2012/0278970 A1 * 11/2012 Bischel ..... A42B 1/225 2/183
2013/0333095 A1 * 12/2013 Dudick ..... A42B 1/205 2/209.12
2014/0101820 A1 * 4/2014 Cho ..... A42B 1/22 2/171
2014/0130235 A1 * 5/2014 Johnson ..... A42B 1/241 2/209.3
2016/0128417 A1 * 5/2016 Hickey ..... A42B 1/22 2/195.1
2017/0367421 A1 * 12/2017 Dworshak ..... D06P 3/006
2018/0325200 A1 * 11/2018 Tunison ..... A42C 1/00
2019/0037952 A1 * 2/2019 Melvin ..... A42B 1/225

OTHER PUBLICATIONS

Shane Thomas, International Search Report and Written Opinion for PCT/US18/17198, dated Apr. 12, 2018, 8 pages, USPTO, Alexandria, Virginia.

* cited by examiner

CONVERTIBLE HEADGEAR

FIELD OF THE DISCLOSURE

The following disclosure relates to headgear that features a cap that is convertible to a mask and vice versa. The headgear includes an adjustable strap stored behind a sweatband that may be used to secure the headgear as a cap or mask, and modified rear crown panels that form a ventilation opening to facilitate a clear nasal passage airway when the headgear is worn as a mask.

BACKGROUND

There are a variety of headgear that include hats/caps that may double as a mask, however, most emphasize the features of one over the other. The features of the headgear functioning as a mask, for example, may be highlighted at the expense of the headgear functioning as a hat or a cap. As a result, such headgear necessarily lack one or more important features balancing the function of the headgear as a hat/cap and a mask.

U.S. Patent Application Publication No. 2011/0023214, for example, discloses headgear that functions as a convertible cap and mask. Here, the headgear is featured as a cap at the expense of the mask to the extent that there is no opening in the headgear for the nose when the headgear is worn as a mask. In addition, the elastic fastener strap for securing the headgear as a mask cannot be hidden when the headgear is worn as a cap.

International Patent Application Publication No. WO 2014/047441 also discloses headgear that functions as a cap and a mask. The cap, however, is compromised to the extent that it is a skull cap without a traditional visor.

BRIEF DESCRIPTION OF THE DRAWINGS

The detailed description is described with reference to the accompanying drawings, in which like elements are referenced with like reference numbers, and in which.

DETAILED DESCRIPTION OF THE ILLUSTRATIVE EMBODIMENTS

Figure 1:
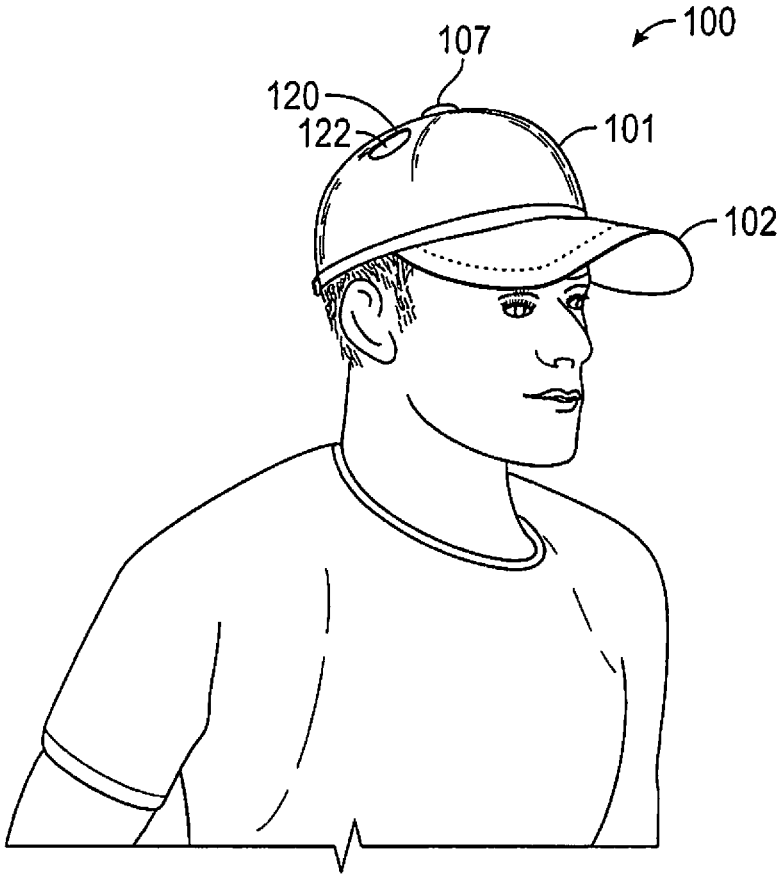
FIG. 1 is a perspective view of a convertible headgear according to the present disclosure illustrating the headgear worn as a cap.

The subject matter disclosed herein is described with specificity, however, the description itself is not intended to limit the scope of the disclosure. The subject matter thus, might also be embodied in other ways, to include different structures, steps and/or combinations similar to and/or fewer than those described herein, in conjunction with other present or future technologies. Although the term "step" may be used herein to describe different elements of methods employed, the term should not be interpreted as implying any particular order among or between various steps herein disclosed unless otherwise expressly limited by the description to a particular order. Other features and advantages of the disclosed embodiments will thus, be or become apparent to one of ordinary skill in the art upon examination of the following figures and detailed description. It is intended that all such features and advantages be included within the scope of the disclosed embodiments. Further, the illustrated figures are only exemplary and are not intended to assert or imply any limitation with regard to the environment, architecture, design, or process in which different embodiments may be implemented.

The headgear embodiments disclosed herein overcome one or more of the prior art disadvantages by balancing the function of the headgear as a hat/cap and a mask. The headgear includes an adjustable strap stored behind a sweatband that may be used to secure the headgear as a cap or mask, and modified rear crown panels that form a ventilation opening to facilitate a clear nasal passage when the headgear is worn as a mask.

In one embodiment, a convertible headgear is disclosed, comprising: i) a cap with a visor and a sweatband, one edge of the sweatband fastened to a portion of an inside edge of the cap; ii) an adjustable strap that secures the cap to a wearer's head, each end of the adjustable strap connected to one of the inside edge of the cap and one side of the sweatband; iii) an adjustable fastener connected to the cap for adjusting a circumference of an edge of the cap, the adjustable fastener including a bottom edge that forms a portion of the edge of the cap and a top edge; iv) a ventilation opening in the cap opposite the visor relative to a top of the cap, wherein the ventilation opening extends from above the top edge of the adjustable fastener at least halfway toward the top of the cap; and v) a pair of vision openings in the cap between the top of the cap and the visor, the pair of vision openings equidistantly spaced from the top of the cap.

In another embodiment, a method for converting headgear from a cap to a mask is disclosed, comprising: i) removing the cap from a wearer's head; ii) positioning the cap over the wearer's face so that a visor of the cap extends above the wearer's head and an adjustable fastener connected to the cap fits under a chin of the wearer's head for adjusting a circumference of an edge of the cap around the wearer's face; and iii) securing the cap to the wearer's head using an adjustable strap, each end of the adjustable strap connected to one of an inside edge of the cap and one side of a sweatband fastened to a portion of the inside edge of the cap.

Referring now to FIG. 1, a perspective view of a convertible headgear 100 according to the present disclosure illustrates the headgear 100 worn as a cap. The headgear 100 includes a cap 101 with a visor 102. The cap 101 and visor 102 may be made from any light weight, breathable or non-breathable material, or any lightweight plastic provided that either is capable of being worn as a cap/hat and mask and embroidered and/or imprinted with a design.

Figure 2A:
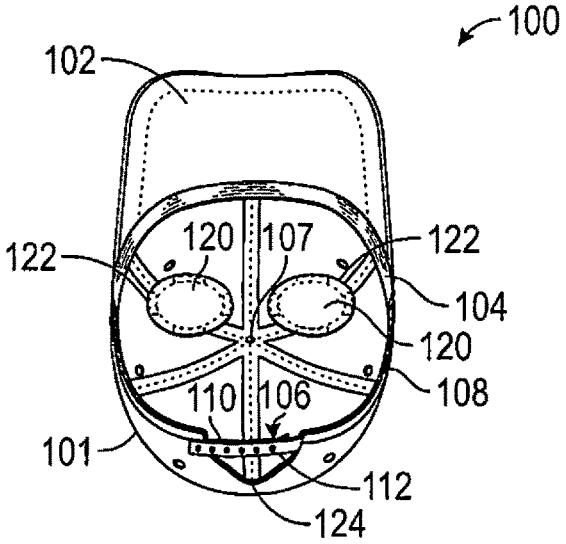
FIG. 2A is a bottom view of the headgear in FIG. 1 illustrating patches that may be used to cover vision openings in the cap when the headgear is worn as a cap.
Figure 4:
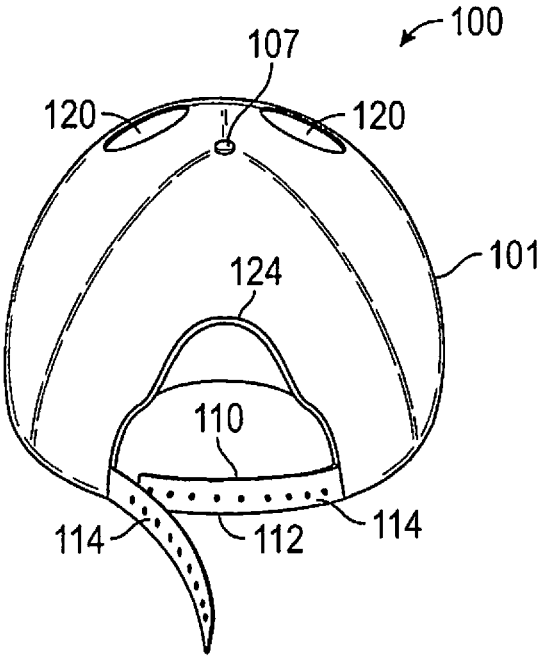
FIG. 4 is rear view of the headgear in FIG. 3 illustrating another perspective of the ventilation opening.

Referring now to FIG. 2A, a bottom view of the headgear in FIG. 1 further illustrates different features of the headgear 100. The cap 101 includes a sweatband 104 with one edge fastened to a portion of an inside edge of the cap 101. An adjustable fastener 106 is connected to the cap 101 opposite the visor 102 relative to a top 107 of the cap 101 for adjusting a circumference of an edge 108 of the cap 101. The adjustable fastener 106 includes a bottom edge 110 that forms a portion of the edge 108 of the cap 101 and a top edge 112. Although the sweatband 104 is not fastened to the adjustable fastener 106, it is fastened to a portion of the inside edge of the cap 101 up to where the adjustable fastener 106 is connected to the cap 101. As illustrated in FIG. 4, the adjustable fastener 106 includes two straps 114. Each strap 114 is connected to the cap 101 at one end and at another end the straps 114 are connected to each other. The straps 114 may be connected to each other using any conventional closure such as, for example, a plastic snap, a hook/loop tape (a.k.a. VELCRO®), a fabric tuck strap with slide closure, a metal buckle closure, a D-Fit closure, and a nylon strap with plastic buckle closure. Alternatively, the design may incorporate a single strap wherein each end is connected to the cap 101 and the strap is manufactured from an elasticated material to provide fit adjustment. The adjustable fastener 106 thus, may be used to adjust the circumference of the edge 108 of the cap 101 around the wearer's face when the headgear 100 is worn as a mask (FIG. 2C) and around the wearer's head when the headgear 100 is worn as a cap (FIG. 1). When the headgear 100 is worn as a cap, the adjustable fastener 106 fits behind the head of the wearer. When the headgear 100 is worn as a mask, the adjustable fastener 106 fits under the chin of the wearer.

Figure 2B:
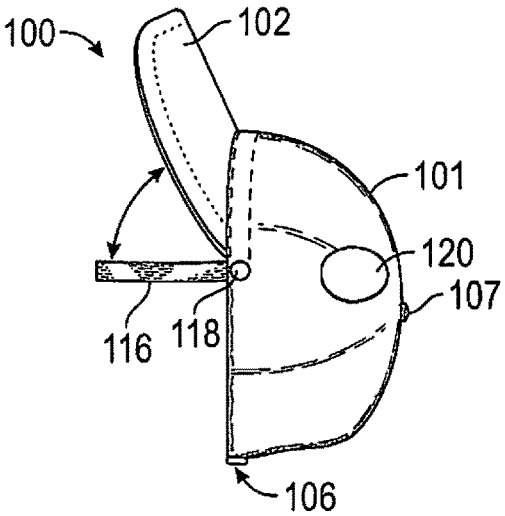
FIG. 2B is a side view of the headgear in FIG. 1 (without patches) illustrating an adjustable strap that is used to secure the cap to a wearer's head when the headgear is worn as a mask.
Figure 2C:
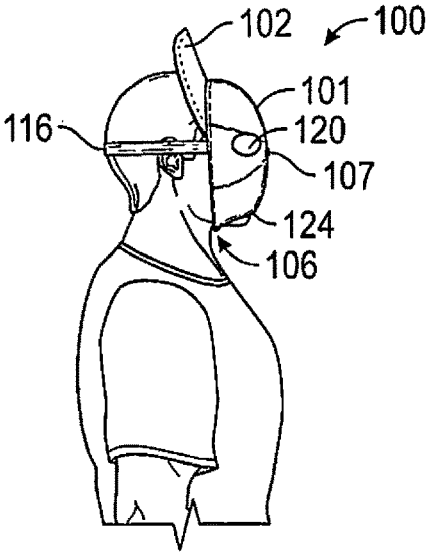
FIG. 2C is a side view of the headgear in FIG. 2B illustrating the headgear worn as a mask.

Referring now to FIGS. 2A-2C, additional perspectives further illustrate the headgear 100 when it is worn as a cap (FIG. 2A) and when it is worn as a mask (FIGS. 2B-2C). An adjustable strap 116 is connected at each end 118 to the inside edge of the cap 101 or one side of the sweatband 104 near the visor 102. If the adjustable strap 116 is connected at each end 118 to one side of the sweatband 104, then preferably it is the side facing the inside edge of the cap 101. The adjustable strap 116 is preferably manufactured from an elasticated material such as neoprene, Spandex, LYCRA®, elastane, elasticated nylon or cotton and may be stored behind the sweatband 104 when the headgear 100 is worn as a cap (FIG. 2A) and may be removed to secure the cap 101 to the wearer's head when the headgear 100 is worn as a mask (FIGS. 2B-2C). Alternatively, the adjustable strap 116 may also be removed to secure the cap 101 to the wearer's head when the headgear 100 is worn as a cap. A pair of vision openings 120 are provided through the cap 101 between the top 107 of the cap 101 and the visor 102. The pair of vision openings 120 are preferably equidistantly spaced from the top 107 of the cap 101 and provide a line of sight when the headgear 100 is worn as a mask (FIGS. 2B-2C, 3-4). Optionally, a material patch strip or pair of patches 122 may be used to cover a respective vision opening 120 when the headgear 100 is worn as a cap (FIGS. 1, 2A). In this manner, the patch(es) 122 may be used to effectively cover, conceal or camouflage the vision openings 120 when the headgear 100 is worn as a cap. Each patch 122 is at least partially detachably-connected to the cap 101 so that each patch 122 may be removed from the line of sight when the headgear 100 is worn as a mask. Preferably, each patch 122 is at least partially detachably-connected to the cap 101 on a surface inside the cap 101 as illustrated in FIG. 2A. However, each patch 122 may be at least partially detachably-connected to the cap 101 on a surface outside the cap 101. Each patch 122 may be at least partially detachably-connected to the cap 101 by a hook/loop tape (a.k.a. VELCRO®) or a hook/loop tape and hinge, for example.

Figure 3:
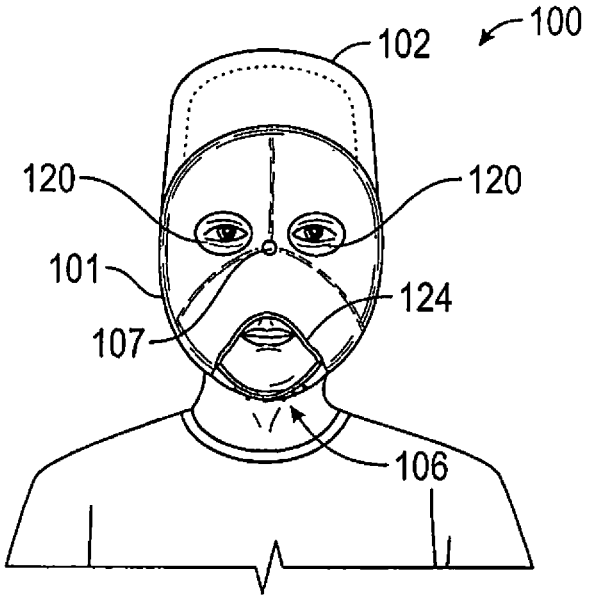
FIG. 3 is a front view of the headgear in FIG. 2C illustrating modified rear crown panels that form a ventilation opening to facilitate a clear nasal passage airway when the headgear is worn as a mask.

Referring now to FIGS. 3-4, a ventilation opening 124 is provided through the cap 101 opposite the visor 102 relative to the top 107 of the cap 101 to facilitate a clear nasal passage airway when the headgear 100 is worn as a mask. The ventilation opening 124 extends from above the top edge 112 of the adjustable fastener 106 at least halfway toward the top 107 of the cap 101. The ventilation opening 124 is preferably twice as wide as it is long between the top edge 112 of the adjustable fastener 106 and the top 107 of the cap 101.

As demonstrated by the features of the convertible headgear disclosed herein, the headgear 100 overcomes one or more of the prior art disadvantages by balancing the function of the headgear 100 as a hat/cap and a mask. The headgear 100 may be easily converted from a cap to a mask by removing the cap 101 from the wearer's head, positioning the cap 101 over the wearer's face so that the visor 102 of the cap 101 extends above the wearer's head and the adjustable fastener 106 fits under a chin of the wearer's head; and securing the cap 101 to the wearer's head using the adjustable strap 116. Similarly, the headgear 100 may be easily converted from a mask to a cap. Any design may be embroidered and/or imprinted on the cap 101 and/or visor 102 to customize the headgear 100 as a cap or a mask. Additional features may also be used to customize the headgear 100 as a mask such as faux ears, glasses, nose and beards.

While the present disclosure has been described in connection with presently preferred embodiments, it will be understood by those skilled in the art that it is not intended to limit the disclosure to those embodiments. It is therefore, contemplated that various alternative embodiments and modifications may be made to the disclosed embodiments without departing from the spirit and scope of the disclosure defined by the appended claims and equivalents thereof.

The invention claimed is:

1. A method for converting headgear from a cap to a mask, comprising:

removing the cap from a wearer's head;

positioning the cap over the wearer's face so that a visor of the cap extends above the wearer's head and an adjustable fastener connected to the cap fits under a chin of the wearer's head for adjusting a circumference of an edge of the cap around the wearer's face; and securing the cap to the wearer's head using an adjustable strap, each end of the adjustable strap connected to one of an inside edge of the cap and one side of a sweatband fastened to a portion of the inside edge of the cap.

2. The method of claim 1, wherein the adjustable fastener is connected to the cap opposite the visor relative to a top of the cap.

3. The method of claim 2, further comprising a ventilation opening in the cap opposite the visor relative to the top of the cap, wherein the ventilation opening extends from above a top edge of the adjustable fastener and at least halfway toward the top of the cap.

4. The method of claim 3, further comprising a pair of vision openings in the cap between the top of the cap and the visor, the a pair of vision openings equidistantly spaced from the top of the cap.

5. The method of claim 4, further comprising a pair of patches, each patch being at least partially detachably connected to the cap over a respective vision opening.

6. The method of claim 5, wherein each patch is at least partially detachably connected to the cap on a surface inside the cap.

7. The method of claim 1, wherein the adjustable strap is connected to the inside edge of the cap.

8. The method of claim 1, wherein the adjustable fastener includes two straps, each strap having one end connected to the cap and another end connected to each other.

9. The method of claim 1, wherein the adjustable fastener is a single elasticated strap with each end connected to the cap.

10. The method of claim 1, wherein the adjustable strap is connected to the one side of the sweatband facing the inside edge of the cap.

* * * * *